42--88
10/15/85 XP 4,546,516

United States Patent [19]
Kim

[11] Patent Number: 4,546,516
[45] Date of Patent: Oct. 15, 1985

[54] COSMETIC TOWEL

[76] Inventor: Yoon H. Kim, 19812 50th W., #614, Lynnwood, Wash. 98036

[21] Appl. No.: 655,160

[22] Filed: Sep. 27, 1984

Related U.S. Application Data

[63] Continuation-in-part of Ser. No. 547,570, Nov. 1, 1983, Pat. No. 4,493,866.

[51] Int. Cl.[4] ..... A47L 17/08; B32B 7/04

[52] U.S. Cl. ..... 15/210 R; 112/410; 112/420; 112/441; 428/88; 428/91; 428/101; 604/378; 604/384; 604/385 R

[58] Field of Search ..... 112/410, 420, 441; 428/88, 91, 101; 15/118, 210 R; 604/378, 384, 385

[56] References Cited

U.S. PATENT DOCUMENTS

| | | | |
|---|---|---|---|
| 857,462 | 6/1907 | Houghton | 112/441 |
| 1,716,364 | 6/1929 | Avery | 428/101 |
| 2,019,842 | 11/1935 | Bussing et al. | 112/441 |
| 2,020,668 | 11/1935 | Wandel | 428/101 |
| 3,169,264 | 2/1965 | Walker | 112/441 |
| 4,144,612 | 3/1979 | Yamaguchi | 112/441 |
| 4,275,105 | 6/1981 | Boyd et al. | 428/219 |
| 4,298,649 | 11/1981 | Meitner | 428/219 |
| 4,490,895 | 1/1985 | Lin | 112/441 |
| 4,493,866 | 1/1985 | Kim | 428/101 |

FOREIGN PATENT DOCUMENTS 32793 7/1981 European Pat. Off. .

*Primary Examiner*—James C. Cannon
*Attorney, Agent, or Firm*—Fleit, Jacobson, Cohn & Price

[57] ABSTRACT

A cosmetic towel or the like for removing moisture from the skin without rubbing or chafing which includes a piece of smooth, slick fabric and two pieces of towel which are layered on each side of the smooth, slick fabric, the layers of fabric and pieces of towel being stitched together around their edges with knitting yarn or the like.

7 Claims, 6 Drawing Figures

COSMETIC TOWEL

This application is a continuation-in-part of U.S. patent application Ser. No. 547,570 filed Nov. 1, 1983 now U.S. Pat. No. 4,493,866.

BACKGROUND OF THE INVENTION

The present invention relates to a cosmetic towel for removing moisture from the skin. More particularly, the present invention concerns a towel which will effectively remove moisture from the skin without rubbing or irritating abrasion. The cosmetic towel of the present invention can also be used to massage the skin by applying finger pressure without direct rubbing of the skin.

Conventional towels are soft to the touch when they are first used. However, after a conventional towel has been washed and dried many times, the loops which are formed on the surface of the towel become worn and the fine hairs of the fabric fall off and become short. As a result, the surface of the towel becomes rough, causing considerable irritation to delicate skin when it is used on the face.

Thus, the use of a conventional towel will repeatedly slough off skin cells and chafe the skin. This rubbing action can also cause abrasion or a slight skin decrease. Of course, abrasion and rubbing can further irritate problem skin which may be characterized by pimples or other wounds on the face or swelled hair follicles and pores. Since these blemishes are raised on the skin, the outer skin is especially prone to sloughing and irritation from rubbing.

Further, the use of a conventional towel can also cause a woman's eyebrows and eyelashes to fall out. And, the soft skin of infants can be damaged when wiping moisture after washing the face or bathing with a conventional towel.

SUMMARY OF THE INVENTION

The present invention is a cosmetic towel or the like which is constructed in a sandwich-like manner by interposing a fabric having a smooth, slick surface between two pieces of gauze or the like. The surfaces of the gauze are then layered between two pieces of towel. Finally, the layers of fabric are joined together by stitching around the edges with sewing thread or the like.

In an alternate embodiment of the present invention, a cosmetic towel or the like is constructed in a sandwich-like manner by interposing a fabric having a smooth, slick surface between two pieces of towel. The layers of fabric and towel are joined together by stitching around the edges with sewing thread or the like.

Thus, it is an object of the present invention to provide a cosmetic towel for effectively removing moisture from the skin without rough rubbing of the skin or abrasive irritating motion.

It is a further object of the present invention to provide a cosmetic towel which will allow massage of the skin by finger-pressure without directly rubbing the skin.

Still further objects of the present invention will become apparent from the following description, drawings, and appended claims.

DETAILED DESCRIPTION OF THE PREFERRED EMBODIMENTS

Figure 1:
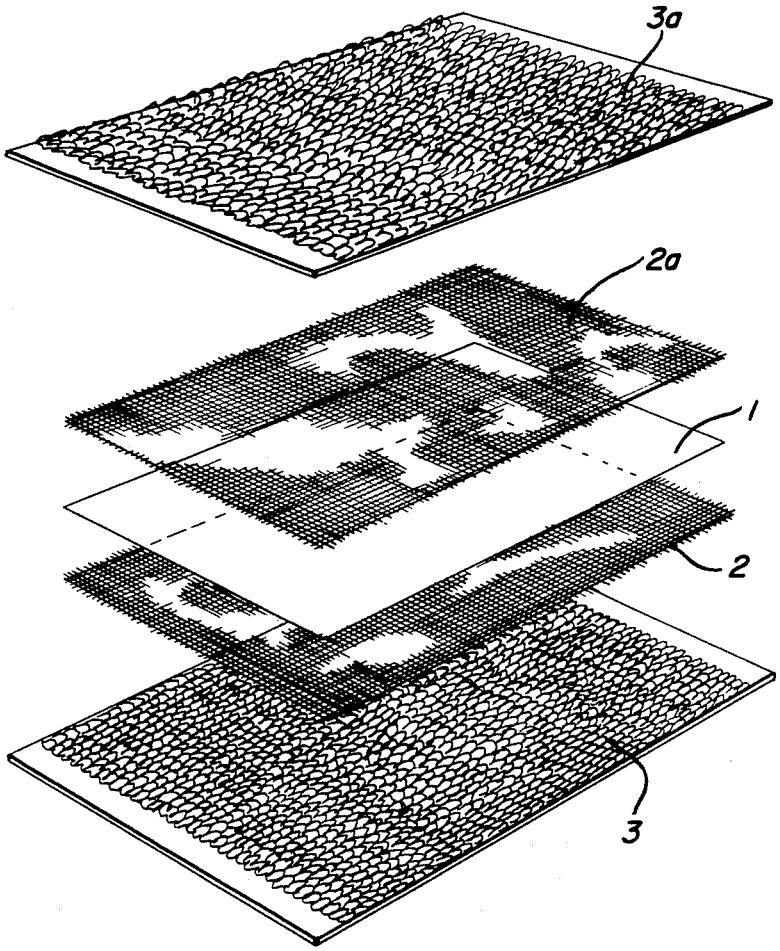
FIG. 1 is an exploded perspective view of the cosmetic towel of the present invention which shows each layer of the towel prior to being stitched together.

Referring now to FIG. 1, the cosmetic towel of the present invention comprises at least two pieces of gauze 2,2*a* which are layered to each side of a piece of fabric 1 having a smooth, slick surface, such as nylon or the like. At least two pieces of towel 3,3*a*, such as terrycloth or the like, comprise the outer surface of the cosmetic towel of the present invention.

Figure 2:
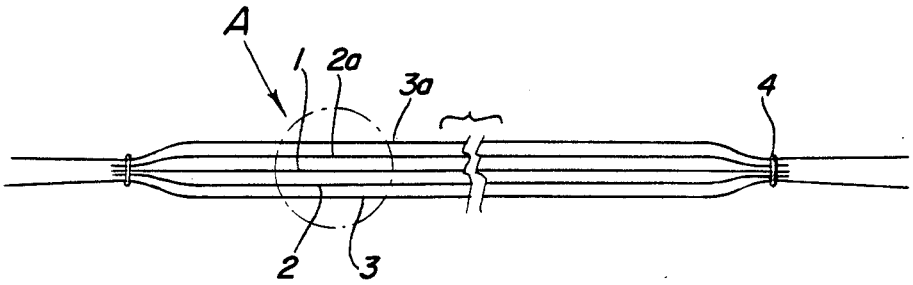
FIG. 2 is a cross-sectional side view of the cosmetic towel in FIG. 1 which shows the layers stitched together at the sides.

The cosmetic towel or the like is constructed in a sandwich-like manner by layering each piece of gauze 2,2*a* on each side of the piece of smooth fabric 1. The two surfaces of the gauze 2,2*a* are then layered between the two pieces of towel 3,3*a*. Finally as shown in FIG. 2, the layers of fabric are joined together by stitching around the edges with sewing thread or the like.

Figure 3:
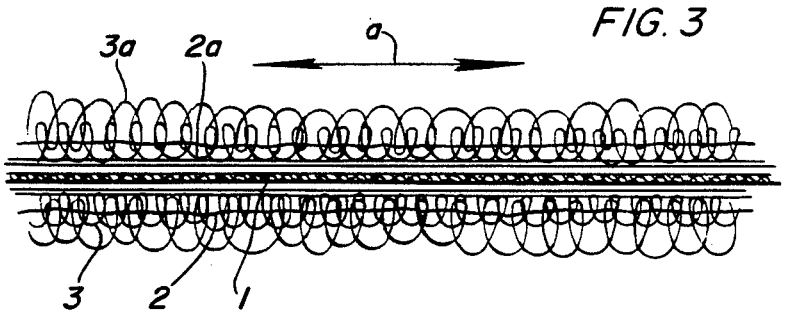
FIG. 3 is an enlarged cross-sectional view of the towel according to FIG. 2.

The cosmetic towel of the present invention is used by touching one side 3 of the towel to the skin, pressing the other side 3*a* of the towel slightly, and rubbing the side of the towel 3*a* in the direction shown by arrow (a) in FIG. 3. While side 3 of the towel remains stationary against the skin, the loops inside the towel 3*a* are caught in the gaps of the gauze 2*a* so that the towel 3*a* moves along the gauze 2*a* and easily slides back and forth against the smooth slick surface of fabric 1. Thus, only the effects of the finger-pressure on side 3*a* of the towel is transmitted to side 3 of the towel which is touching the skin. This action allows the cosmetic towel of the present invention to absorb moisture along the area of the towel under pressure from the fingers, without giving any rubbing stimulus to the skin.

Figure 4:
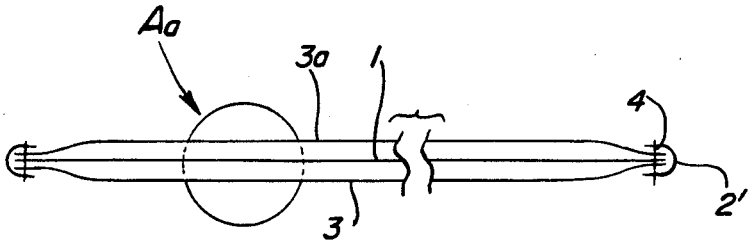
FIG. 4 is a cross-sectional side view of an alternate embodiment of the cosmetic towel which shows the layers stitched together at the sides.

Referring now to FIG. 4, the cosmetic towel of the present invention comprises at least two pieces of towel 3,3*a* which are layered to each side of a piece of fabric 1 having a smooth, slick surface, such as nylon or the like. The pieces of towel 3,3*a* are made of terrycloth or the like, and comprise the outer surface of the cosmetic towel of the present invention.

The cosmetic towel or the like is constructed in a sandwich-like manner by layering each piece of tower 3,3*a* on each side of the piece of smooth fabric 1. Finally, as shown in FIG. 4, the layers of fabric are joined together by tape 2', which is stitched around the edges by knitting yarn 4 or the like.

Figure 5:
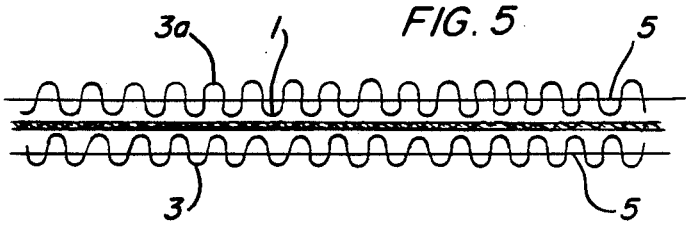
FIG. 5 is an enlarged cross-sectional view of the towel encircled by Aa in FIG. 4.

In FIG. 5, the enlarged cross-sectional view of the towel shown in FIG. 4, illustrates that the pieces of towel 3,3*a* each include central support 5, having towel loops on either side. The towel pieces may be made of terrycloth or the like. As the towel shown in FIG. 5 is used, the exposed outer loops of the towel become worn. In this event, the knitting yarn 4 is removed from the tape 2' and then one or both towel pieces 3,3*a* are reversed and resewn to each other and tape 2' to effectively double the life of the cosmetic towel.

Figure 6:
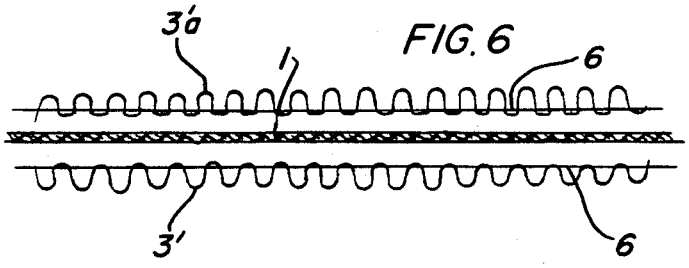
FIG. 6 is an alternate embodiment of an enlarged cross-sectional view of the towel encircled by Aa in FIG. 4.

In the enlarged cross-sectional view of the towel of FIG. 4 shown in FIG. 6, the support 6 for the pieces of towel 3'*a* and 3' are located adjacent to the base of the loops and is positioned closest to the smooth, slick fabric 1. The exposed loops are therefore at a maximum length for added life of the cosmetic towel. The supports 5 and 6 shown in FIGS. 5 and 6 are each made of nylon fabric or the like.

The cosmetic towel of the present invention is particularly advantageous when absorbing moisture from blemished skin. Ordinarily, in such a case, you would press the skin firmly with a towel and pat the skin dry to avoid rubbing or an abrasive action along the contours of the face. However, it is now possible, with a cosmetic towel according to the present invention, to wipe away the moisture without irritating or damaging the blemished skin.

The cosmetic towel of the present invention offers a further advantage in that the face is gently massaged by the rubbing action and finger pressure applied when using the towel. Thus, use of the cosmetic towel has a beneficial effect on the beauty of the user.

Although one specific cosmetic towel has been described above, it should be understood that this embodiment is described for illustrative purposes only and that numerous alterations and modifications may be practiced by those skilled in the art without departing from the spirit and scope of the invention. Accordingly, it is the intent that the present invention not be limited to the above, but to be limited only as defined in the appended claims.

I claim:

1. A cosmetic towel or the like comprising:

a planar piece of smooth, slick fabric, and two pieces of towel, one each of said two pieces of towel being layered on each side of said smooth, slick fabric, said layers of smooth, slick fabric, and towel being stitched together around the edges with sewing thread or the like, the arrangement being such that each of the pieces of towel is in movable relationship with the face of the smooth, slick fabric with which it is superposed.

2. A cosmetic towel according to claim 1, wherein said smooth, slick fabric is nylon.

3. A cosmetic towel according to claim 1, wherein said pieces of towel are made of terrycloth.

4. A cosmetic towel or the like for use in removing moisture from delicate skin, said cosmetic towel or the like comprises a layer of smooth, slick fabric, and at least two layers of towel being assembled in a sandwich-like manner in the following order: a layer of towel, a layer of smooth, slick fabric, and another layer of towel, said layers being attached in an arrangement such that each of the layers of towel is in movable relationship with the face of the smooth, slick fabric with which it is superposed.

5. A cosmetic towel according to claim 4, wherein said layers of smooth fabric, and towel are stitched together around the edges with knitting yarn.

6. A cosmetic towel according to claim 4, wherein said layer of smooth, slick fabric is nylon.

7. A cosmetic towel according to claim 4, wherein said layers of towel are terrycloth.

* * * * *